United States Patent [19]

Johnson

[11] 4,314,476

[45] Feb. 9, 1982

[54] WELL FLUID VELOCITY MEASUREMENT METHOD AND SYSTEM

[75] Inventor: Irvin D. Johnson, Englewood, Colo.

[73] Assignee: Marathon Oil Company, Findlay, Ohio

[21] Appl. No.: 153,505

[22] Filed: May 27, 1980

[51] Int. Cl.[3] ..... E21B 47/00

[52] U.S. Cl. ..... 73/155

[58] Field of Search ..... 73/155, 861.42, 861.52

[56] References Cited

U.S. PATENT DOCUMENTS 2,277,898 3/1942 Andrew ..... 73/155

2,674,877 4/1954 Silverman et al. ..... 73/155

*Primary Examiner*—Herbert Goldstein

*Attorney, Agent, or Firm*—Jack L. Hummel

[57] ABSTRACT

The invention provides a system and method measuring high and low fluid velocity in well bores and particularly for fluids exhibiting stirring action. The system and method (300) includes a restrictor (310) inserted into the bore hole (10) at a desired depth which minimizes stirring action (40) and impedes the upward flow of the fluids and a sensor (320) measuring any difference in fluid pressure above and below the restrictor. The restrictor (310) is pulled upwardly by cable (340) connected to powered reel (430 and 440) at a velocity sufficient to maintain the differential pressure ($\Delta P$) across the restrictor (310) at zero. When the differential pressure ($\Delta P$) is zero, the velocity at which the restrictor (310) moves upwardly in the bore hole (10) is equal to the velocity of the fluids in the vicinity of the restrictor (310). The velocity of the pulled cable (340) can be sensed and recorded as the velocity of the multi-phase fluids.

9 Claims, 9 Drawing Figures

452
PRESSURE FEEDBACK
450

444
430
REEL
442
MOTOR
440
470
AMPLIFIER
472
480
VELOCITY RECORDER
460
SENSOR
462
410
340
420
400
432
422
10
30
434
340
424
310
320
436
320
426

WELL FLUID VELOCITY MEASUREMENT METHOD AND SYSTEM

DESCRIPTION

TECHNICAL FIELD

The present invention relates to methods and systems measuring productivity of wells and, more particularly, to systems which measure fluid velocities in well bores.

BACKGROUND ART

A number of conventional methods exist for measuring fluid velocities in well formations producing gas, oil, or water.

In FIGS. 1 and 2 are shown two prior art devices for measuring fluid velocity in a well bore. In FIG. 1, the well bore 10 is shown to contain a multi-phase fluid 20 moving in the direction of arrow 30. The multi-phase fluid 20 contains, for example, a mixture of oil and gas or oil, gas and water in differing amounts. In slant bore hole 10, such multi-phase fluids moving in the direction of arrow 30 typically undergo stirring action which creates circulating cells 40 that move upwardly with the fluid 20.

In FIG. 1 is shown a conventional spinner or turbine meter 50 which spins in response to the fluid flowing through it. In slant bore hole configurations, such spinners 50 are typically oriented close or near the lower edge 60 of the bore hole 10. The region of the fluid 20 near edge 60 is typically the region in which the stirring action 40 most frequently occurs. Depending upon the composition of the multi-phase fluid and its location, a conventional spinner 50 may, at times, actually be caused to be driven in the reverse direction by the stirring action 40 thereby resulting in the possibility of an erroneous reading as to the true upward velocity rate of the fluid 20 in the direction of arrow 30. The measurements must be individually made at different locations in the bore hole.

Another conventional prior art approach is shown in FIG. 2 and is commonly called a "packer flow meter". The packer flow meter 200 comprises a packer portion 210 and a centrally disposed spinner 220 suspended from a wire-line or cable 230. In operation, the packer portion 210 is collapsed about its central section 240 while it is being lowered into the bore hole 10. When it is at its desired depth, the packer portion 210 is expanded outwardly in the direction of arrow 250 to firmly abut against the inside edges of the bore hole 10. In this configuration, the instrument is firmly "packed" into place in a fixed position. The fluid 20 is now caused to enter the central region 240 and to pass through the spinner 220; the fluid then exits upwardly into bore hole 10. As can be observed in FIG. 2, the stirring action 40 is prohibited from occurring and the device provides an overall accurate reading of the velocity of the fluid flow 20. The packer flow meter set forth in FIG. 2, however, is usable only for low velocity fluid flow and will not work for high velocity flows. In high velocity flow situations the restriction created by confining the fluid flow through channel 240 causes the packer flow meter to slide upwardly or possibly to be blown out of the bore hole due to a fluid pressure buildup. For each separate location, the packer flow meter must be deflated and re-packed to provide readings.

As the result of a patentability search conducted for the present invention, the following prior art approaches were uncovered:

| Patent No. | Inventor | Issue Date |
|---|---|---|
| (U.S.) 2,158,569 | L. Bowen | 5-16-39 |
| (U.S.) 2,277,898 | T. A. Andrew | 3-31-42 |
| (U.S.) 2,674,877 | D. Silverman, et al | 4-13-54 |
| (Aust) 262,730 | Heel, et al | 3-21-62 |
| (U.S.) 3,839,914 | Modisette, et al | 10-8-74 |
| (U.S.) 3,871,218 | Louis | 3-18-75 |

The 1954 patent issued to Silverman, et al sets forth a well productivity measurement method that utilizes an injected identifiable liquid barrier such as an oil emulsion or an oil base gel. This identifiable fluid body is pushed upwardly in the well bore by the fluids at a rate substantially equal to the velocity of the fluids. Silverman utilizes a set of contacts of identify the interface between the fluids and the identifiable fluid body. By pulling the contacts upwardly and preserving the contact interface, the velocity of the fluids can be ascertained. However, the Silverman, et al approach is not adapted for slanted bore holes and is especially not adapted for multi-phase fluids exhibiting stirring action. The mere presence of stirring action would cause the identifiable fluid body to substantially intermix with the multi-phase fluids causing Silvermans's approach to be inoperative.

In the Modisette, et al approach, fluid must be caused to flow through a separate conduit at the surface of the bore hole. Such an approach is not suitable for measuring the velocities of the different formations.

The 1942 Andrew approach utilizes a differential pressure measurement by sensing pressure above and below its probe. The probe, however, is designed to remain stationary in the bore hole as the fluids flow upwardly therefrom. The probe will record the differential pressure at that position in the bore hole. The probe is then moved to a new position and the differential pressure is recorded at the new position. The mechanism for recording the differential pressure is located in the interior of the probe. The 1939 patent issued to Bowman relates to a formation tester to ascertain whether or not perforations in the bore hole are plugged. The 1975 patent issued to Louis relates to an apparatus which performs a number of tests ascertaining the permeability characteristics of a coarse or fissured medium. Specifically, Louis uses a conventional spinner flow meter to measure velocity flow. The 1962 Australian patent issued to Heel, et al also relates to an apparatus for testing petroleum formations. Again, Heel, et al utilizes a spinner element 46 for sensing flow rates.

DISCLOSURE OF INVENTION

The problem faced in measuring multi-phase fluid velocities in slanted well bores is to formulate a single system and method of fluid velocity measurement which can be utilized for both high and low velocity flows and one whose readings are not affected by the stirring action of the multi-phase fluids and the slant of the well bore.

The well fluid velocity measurement system of the present invention provides a solution to the problem and includes a restrictor which is selectively insertable into a well bore to a desired depth wherein the restrictor is capable of substantially minimizing the stirring action occurring in multi-phase fluids, a differential environmental condition sensor such as a pressure sensor or a flow servo, located above and below the restrictor for sensing the difference in environmental conditions and for extending a differential condition upwardly through an electrical cable to the surface above the well bore, a reel connected to a motor for pulling the restrictor upwardly in the well bore, a feedback circuit which responds to the differential condition for causing the motor to drive the reel at a rate wherein the differential condition (e.g., pressure) across the restrictor is substantially maintained at zero, and a sensor for measuring the velocity of the cable which is attached to the restrictor as it is being pulled upwardly the velocity of the cable being equal to the velocity of the fluid in the vicinity of the restrictor.

The method of measuring well fluid velocity includes the step of inserting an unexpanded restrictor carrying a differential environmental condition sensor into the well bore to a desired depth, expanding the restrictor in the well bore, sensing the differential conditions on opposing ends of the restrictor, pulling the restrictor upwardly in the bore hole at a sufficient rate to maintain the differential condition (e.g., pressure) across the restrictor at substantially zero, and measuring the velocity at which the restrictor is pulled upwardly.

In comparison to the conventional prior art approaches shown in FIGS. 1 and 2, the present invention can be utilized for both high and low fluid velocities. The present invention also substantially minimizes stirring action from occuring as found in FIG. 1 and does not impede fluid flow as found in FIG. 2. Furthermore, the prior art approaches require discrete readings at fixed locations whereas the present invention provides a continuous measurement of the fluid velocities.

BRIEF DESCRIPTION OF DRAWING

The details of the present invention are described in the accompanying drawing.

BEST MODE FOR CARRYING OUT THE INVENTION

Figure 1:
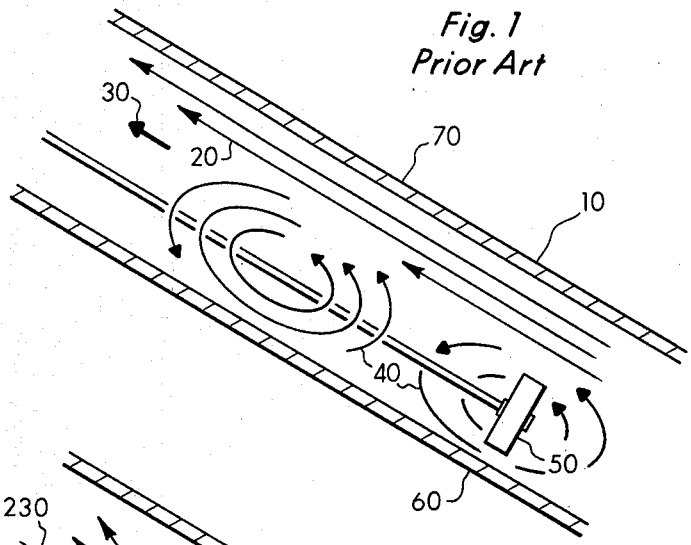
Fig. 1 Prior Art
FIG. 1 sets forth an illustration of a conventional spinner flow meter for use in high fluid velocity bore holes.
Figure 2:
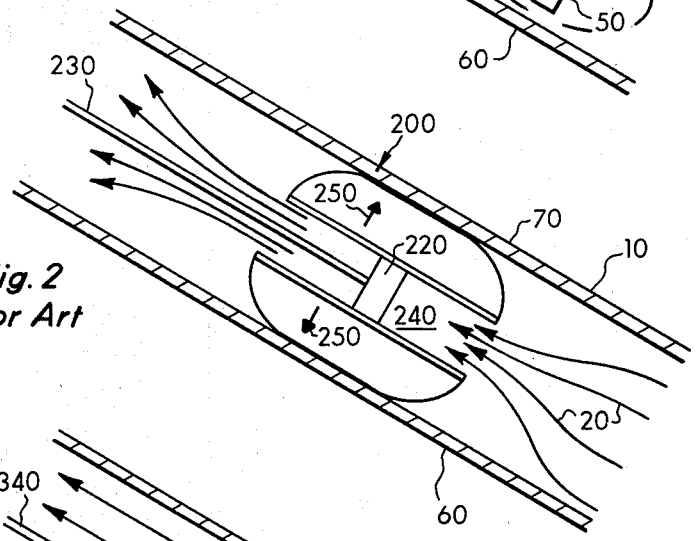
Fig. 2 Prior Art
FIG. 2 sets forth an illustration of a conventional packer flow meter for measuring flow in low fluid velocity bore holes.
Figure 3:
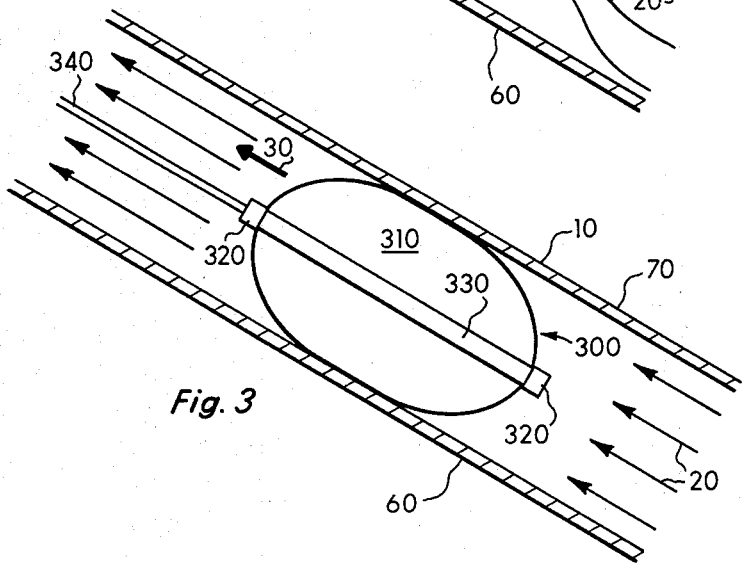
FIG. 3 sets forth an illustration of the restrictor of the present invention for measuring both high and low fluid flow in bore holes.

The present invention 300, shown in FIG. 3 includes a restrictor 310 which is expanded after it is inserted into a bore hole to restrict stirring action 40 from occurring and to impede the fluid flow. Restrictor 310 of the present invention, however, does not "pack" against the edges 60 and 70 of the bore hole as does the prior art approach in FIG. 2. The restrictor 310 functions to substantially reduce stirring action 40 and is designed to be pulled upwardly in the direction of arrow 30. The restrictor 310 is able to slide upwardly along edges 60 and 70 of the bore hole.

Furthermore, the present invention 300 does not use spinners or other conventional velocity measuring instruments to measure the velocity of the fluid flow. Rather, the present invention 300 utilizes a pair of environmental condition sensors 320, such as pressure sensors, located on opposite ends of the central portion 330. The sensors 320 acts as a differential condition sensor to send a differential condition into an electrical cable 340.

The restrictor 310 carrying the sensors 320 is pulled upwardly in the bore hole in the direction of arrow 30 at a rate sufficient to maintain the differential condition such as pressure substantially at zero. The velocity rate of the restrictor as it is being pulled substantially equals the velocity rate of the fluid flow in the vicinity of the restrictor. In this fashion, the velocity of the fluid flow can be accurately measured, whether the fluid flow is high or low, and without the detrimental effects of any stirring action 40.

Figure 4:
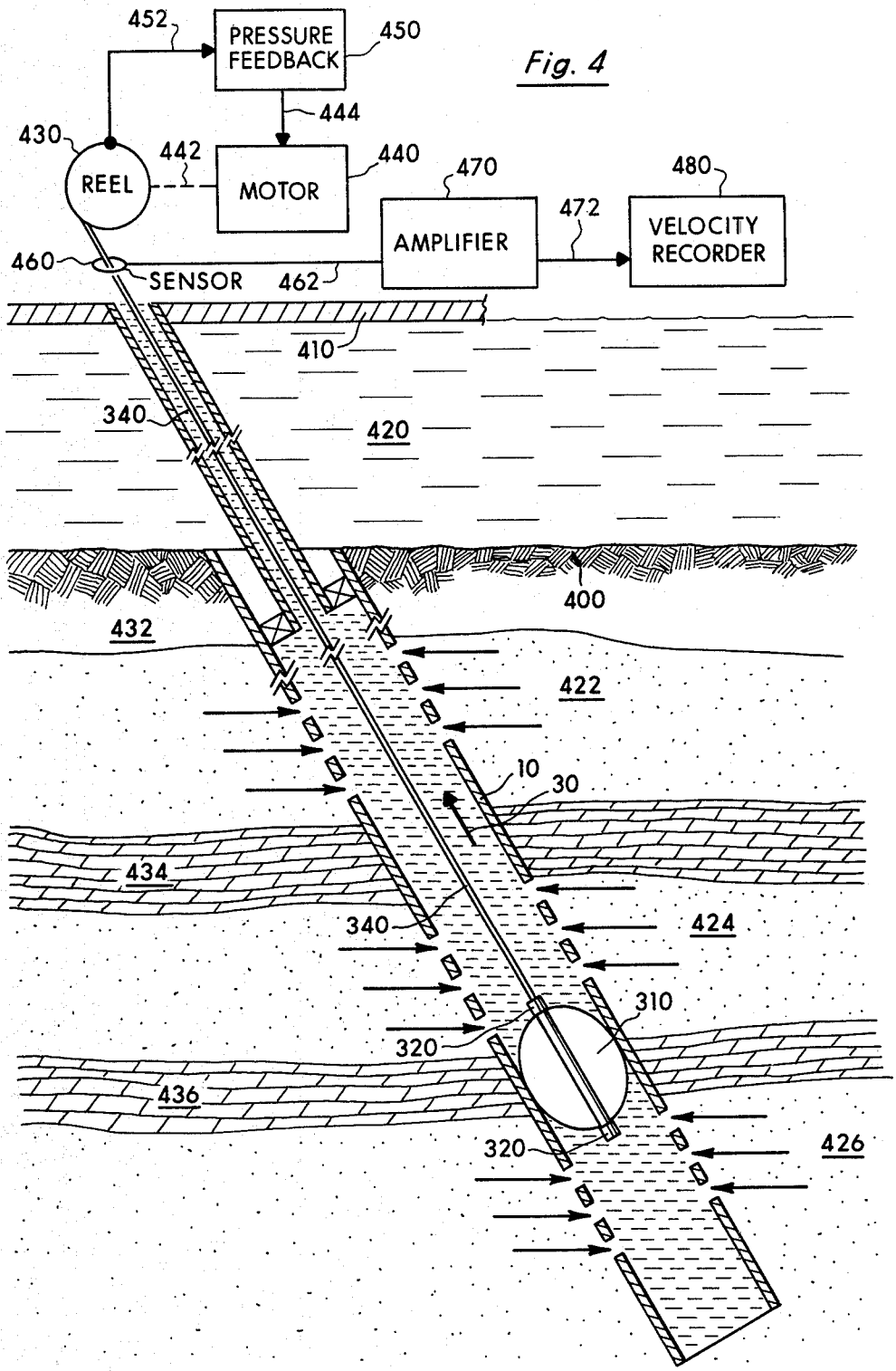
FIG. 4 sets forth an illustration of the system of the present invention showing, diagrammatically in cross-section, a well and producing formations.

In FIG. 4 is shown the system of the present invention operatively installed in a well bore 10. In FIG. 4, the well bore is slanted and is formed in the ocean floor 400. The electronic equipment of the present invention is primarily located on an offshore platform 410 standing in water 420. The system shown in FIG. 4 is shown primarily in schematic form—it is to be understood that the technology for drilling slant well bores from floating rigs is conventional and is well known.

The restrictor 310 of the present invention is connected to an electrical cable 340 and is pulled upwardly in direction of arrow 30. It is the goal of the restrictor 310 to substantially minimize stir action occurring in the well bore 10 from different phased fluids. For example, and shown in FIG. 4, the well bore 10 receives fluid from at least three different formations—designated 422, 424 and 426 which are separated by strata 432, 434 and 436, respectively. These different formations could be injecting gas, oil, or water or a combination of all three in differing proportions. Furthermore, the velocity of input into the well bore 10 can vary significantly from each different level. Hence, considerable stirring action may result in the well bore 10. The stirring action can be affected by the angle the well bore takes with the floor of the ocean. Typically, the more slanted the bore hole 10, the greater the stirring action becomes.

The system of the present invention includes the take-up reel 430 which pulls the restrictor 310 upwardly in the direction of arrow 30. A motor 440 is mechanically attached to reel 430 by means of a shaft 442. The speed at which the motor 440 drives the reel 430 is governed by signals over leads 444 from a pressure feedback circuit 450. The pressure feedback circuit, in turn, receives electrical signals over leads 452 which electrically receives the signals from the cable 340 off of the reel 430.

In operation, the differential pressure across both ends of the stir restrictor 310 is sensed by the pressure sensors 320 (or a single differential sensor). A differential pressure signal is extended up through cable 340 to the take-up reel 430 and is delivered over leads 452 into a pressure feedback circuit 450. The pressure feedback circuit 450 causes the motor 440 to increase or decrease its speed so that the velocity of the stir restrictor 310 equals the velocity of the upwardly flowing fluids. As is well known in the art, the velocity of the fluid changes as the restrictor passes through the different formations 422, 424, and 426. Hence, the velocity change of the fluid will be reflected in a differential pressure change which will be immediately sensed by the differential pressure sensors 320 and delivered into the pressure feedback circuit 450 to approximately modify the velocity of the restrictor 310.

The velocity of the restrictor 310 is equal to the velocity with which the reel 430 takes up wire 340 and, hence, a sensor 460 can be utilized to detect the speed at which the take-up wire 340 is traveling. The electrical signals proportional to the speed of the take-up cable 340 are delivered over leads 462 to an amplifier 470 and the amplified signals are delivered over leads 472 to a velocity chart recorder 480. The velocity chart recorder, therefore, accurately records the velocity of the stir restrictor 310 as it travels upwardly in the bore hole 10 at the measured depth.

The sensor 460, amplifier 470, and recorder 480 are conventional and can be of the types manufactured and used by Gearhart-Owen of Fort Worth, Texas or Schlumberger, Ltd. for well logging. Specifically, the sensor 460 can be a cable tachometer.

While the sensor amplifier and velocity recorder shown in FIG. 4 are preferred, any of a number of different approaches can be used within the spirit of the present invention. For example, the sensor 460 can be configured and adapted to receive signals off of the mechanical shaft 442 of motor 440, or off the reel 430. All of these approaches could be designed to provide an electrical signal to the amplifier 470 which is proportional, in some manner, to the speed with which the stir restrictor 310 is pulled upwardly in the bore hole 10.

Figure 5:
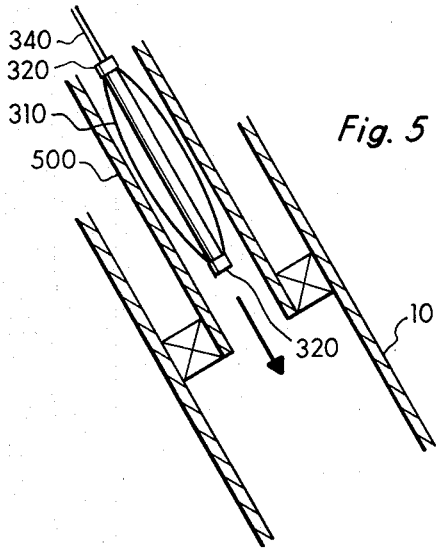
FIG. 5 illustrates, in cross-section, the restrictor of the present invention being injected into the bore hole.
Figure 6:
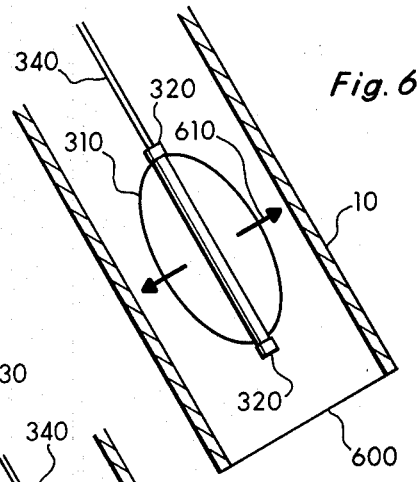
FIG. 6 is an illustration, in cross-section, of the restrictor of the present invention being expanded in the bore hole at the predetermined desired location.
Figure 7:
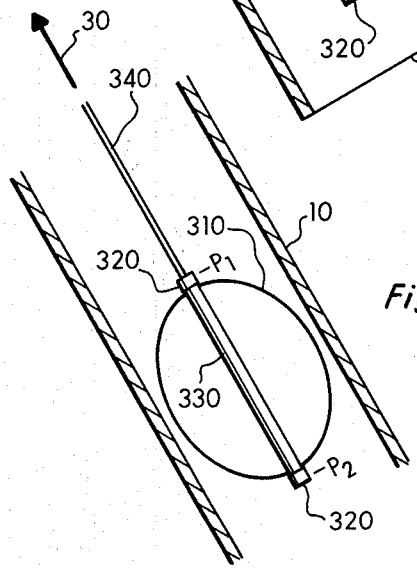
FIG. 7 is a cross-sectional view of the restrictor of the present invention fully expanded and being pulled upwardly in the bore hole.

In FIGS. 5 through 7 shown the method of inserting the restrictor 310 into the bore hole. In FIG. 5, the unexpanded restrictor 310 is inserted down the intake pipe 500 and into the bore hole 10. The unexpanded restrictor 310 is dropped until it reaches a desired depth; for example, near the bottom 600 of the bore hole as shown in FIG. 6. When it is dropped to its predetermined location, electrical signals are transmitted through cable 340 which could be a coax cable, a plurality of wires, or another conventional interconnection used to deliver electrical signals to a probe in a bore hole 10 as well as to support the probe. The restrictor 310 is conventionally expanded outwardly in the direction of arrows 610 such as by pumping the collapsible bags 335 full of the fluids found in the bore hole 10. The stir restrictor 310 is then fully expanded, although not packed, against the side wall 10. According to the teachings of the present invention, the stir restrictor 310 does not have to be fully expanded to engage against the walls of the bore hole 10. The purpose of the expanded restrictor 310 is to substantially minimize any detrimental effect due to the stirring action and to impede the fluid flow so that a differential pressure can be sensed. The weight and shape of the unexpanded stir restrictor 310 is such that it will drop downwardly into the bore hole to the desired depth.

In the preferred embodiment, a typical packer is modified so as not to pack against the sides 60 and 70 of the bore hole 10 and is of the type manufactured by Schlumberger Ltd. and called the Packer Flowmeter. It is also expressly understood that while the preferred approach utilizes a modified packer, the principles of any suitable flow restrictor that provides impedance such as fins can also be adapted.

The expanded restrictor 310 is then pulled upwardly by means of wire or cable 340 in the direction of arrow 30. The pressure sensors 320 termed $P_1$ and $P_2$ in FIG. 7 sense the pressure at opposing ends of the restrictor 310. If the restrictor 310 is being pulled up at a velocity which is generally less than the velocity of the fluid flow, then a higher pressure will be sensed at $P_2$ and a differential pressure will exist between $P_1$ and $P_2$. This differential pressure will generate an electrical signal ($\Delta P$) over wire 340 which is delivered into the pressure feedback circuit 450 and which would cause the motor 440 to increase the speed of the take-up reel 430. Hence, the differential pressure between $P_1$ and $P_2$ would be quickly brought substantially down to zero. On the other hand, if the restrictor 310 is being pulled too fast, a greater pressure would be sensed by $P_1$ and a lesser pressure would be sensed by $P_2$ and the pressure feedback circuit 450 would instruct the motor 440 to slow the speed of the take-up reel 430 and, hence, the differential pressure, again, would be brought quickly to substantially zero.

In operation, it can be readily observed, that the system of the present invention substantially minimizes the error due to stirring action and results in an accurate velocity measurement of both high and low velocity multi-phase fluids in slant bore hole situations.

It is to be expressly understood that other types of environmental sensors other than pressure sensors could also be used. For example, flow servos could also be used to sense a differential condition. The pressure sensors, however, shown in the drawings represent the preferred embodiment.

The environmental condition sensors 320 are mounted to a central body 330. The specific construction of the central body 330 shown in FIG. 7 is not important to the teachings of the present invention and could comprise a variety of different shapes and configurations.

Figure 8:
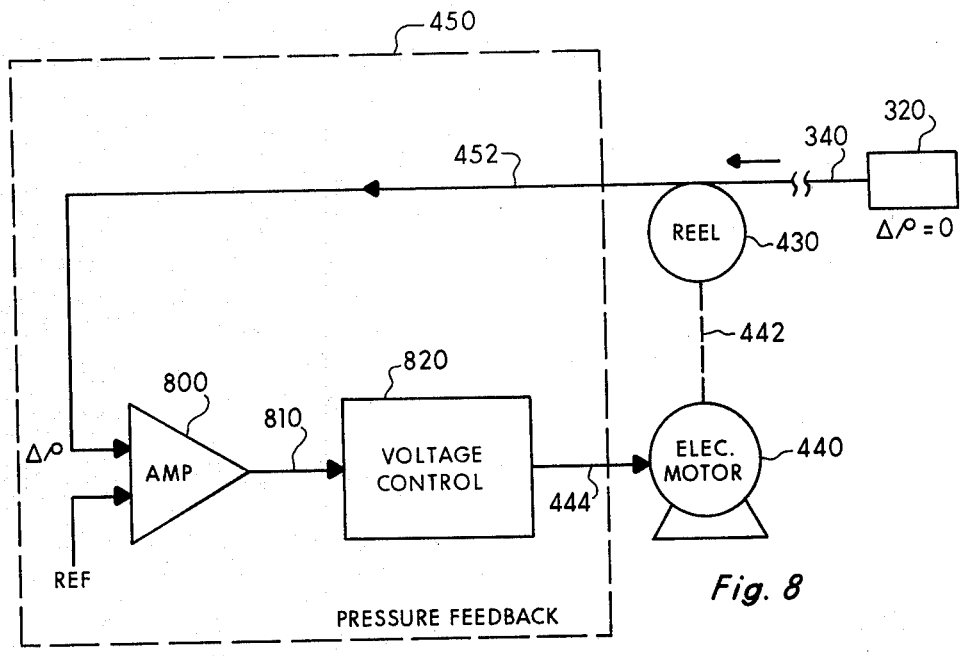
FIG. 8 is a schematic of a first embodiment of the pressure feedback control circuit of the present invention.

In FIG. 8 is shown a first embodiment of the differential pressure feedback circuit of the present invention. The differential pressure signal is sent from the sensors 320 over the cable 340 electrically through the reel into wires 452 and into the pressure feedback circuit 450. The electrical pick-off from the reel is conventional in the embodiment shown in FIG. 8, the pressure feedback circuit 450 includes an amplifier 800 which compares the differential pressure signal appearing on lead 452 to a reference value to generate an amplified signal 810 into a voltage control circuit 820. The voltage control circuit reacts to the magnitude of the signal appearing on lead 810 to increase or decrease the speed of the electric motor 440. The voltage control circuit 820 is conventional and can be a typical SCR voltage control circuit which controls the amount of power delivered to the electric motor 440 and thus controls the speed of shaft 442. The amplifier 800 and the voltage control circuit are also conventionally available.

Figure 9:
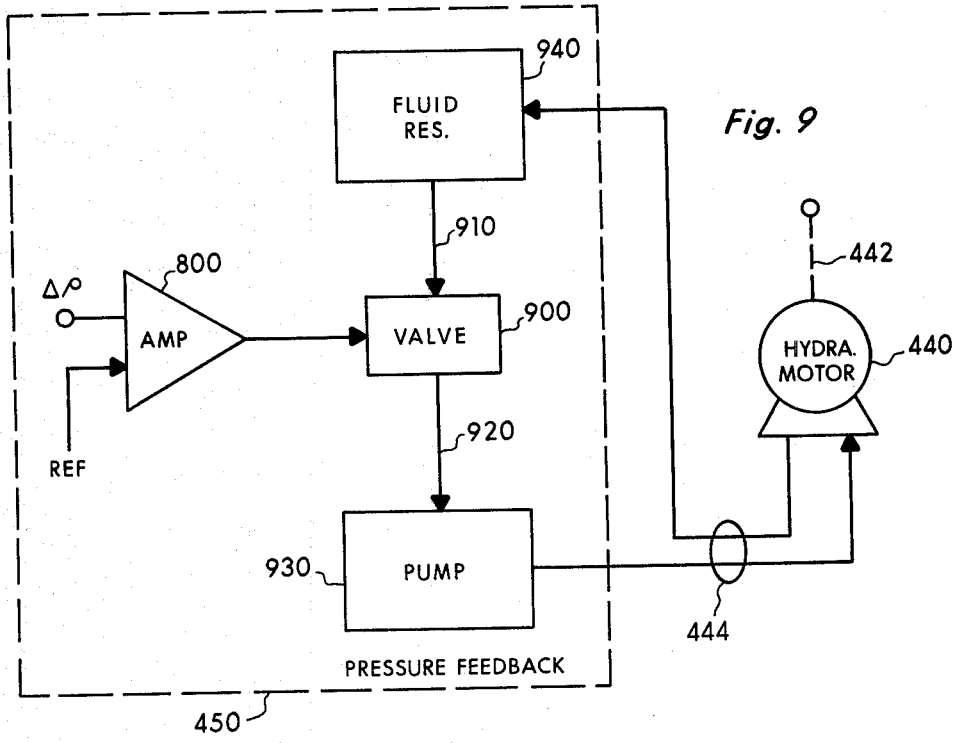
FIG. 9 is a schematic diagram of a second embodiment of the pressure feedback control circuit of the present invention.

In FIG. 9 is shown a different embodiment which utilizes a pressure feedback circuit 450 that controls hydraulic fluid going into a hydraulic motor 440. The amplifier 800 operates in a similar fashion as shown in FIG. 8 to control an electrical valve 900 which controls the amount of fluid flowing in lines 910 and 920 and which drives a pump 930 in a conventional fashion. A fluid reservoir 940 is provided to provide fluid for the hydraulic motor 440. Hence, the amplifier 800 can electrically control the valve to increase or decrease the pressure of the hydraulic fluid to the hydraulic motor 440.

The method of measuring the fluid velocities of multi-phase fluids in slanted well bores is shown in FIGS. 4 through 7. The unexpected restrictor 310 carrying the differential environmental condition sensor 320 is inserted into the well bore 10 to the desired depth. The restrictor 310 is expanded to substantially minimize the stir action which may include an expansion near the sides of the well bore. The stir restriction may also occur from any apparatus that impedes the flow of the fluids in order to create the differential condition while at the same time substantially inhibiting stir action from occurring. The differential condition is then sensed and the take-up reel 430 is activated to pull the restrictor 310 upwardly at a sufficient rate to maintain the differential condition such as pressure at substantially zero across the restrictor 310. When that occurs, the restrictor is traveling at substantial velocity of the multi-phase fluid and the velocity of the pulled cable can be sensed and recorded.

The system and method of the present invention is clearly adaptable to fluid flows in bore holes which are not slanted and to bore holes which do not have stirring action. And, while the method and system of the present invention has been specifically set forth in the above disclosure, it is to be understood that modifications and variations to both the method and the system can be made which would still fall within the scope and coverage of the appended claims herewith.

I claim:

1. An improved method of measuring the velocities of fluids flowing in a well bore hole, wherein the improvement comprises the steps of:

inserting an unexpanded restrictor (310) carrying a differential environmental condition sensor (320) into the bore hole (10) to a desired depth;

expanding the restrictor (310) in the bore hole (10) at said desired depth, said expanded restrictor (310) being capable of substantially minimizing any stirring occurring in said fluids and impeding the flow of said fluids;

sensing a differential environmental condition on opposing ends of the restrictor (310) with said sensor (320);

pulling (430, 440 and 450) the restrictor (310) at a sufficient velocity upwardly in the bore hole (10) to maintain the sensed differential environmental condition at substantially zero; and measuring (460, 470, and 480) the velocity at which the restrictor (310) is pulled, said measured velocity being substantially equal to the velocity of fluids in the well in the vicinity of said restrictor (310).

2. The improved method of claim 1 wherein the step of sensing the differential environmental condition further comprises the steps of:

sensing (320) the fluid pressure of the fluid above ($P_1$) and below ($P_2$) the restrictor (310), and generating a differential pressure ($\Delta P$) in response to said sensed fluid pressures ($P_1$ and $P_2$).

3. The improved method of claim 2 wherein the step of pulling the restrictor further comprises the steps of:

pulling the restrictor (310) by means of a cable (230) affixed to a take-up reel (430);

receiving (450) the sensed differential pressure ($\Delta P$) through said pulled cable (330); and driving the take-up reel (430) in response to said received differential pressure (450) by means of a motor (440) at a rate sufficient to maintain the sensed differential pressure ($\Delta P$) at substantially zero.

4. The improved method of claim 1 wherein the step of pulling the restrictor further comprises the steps of:

pulling the restrictor (310) by means of a cable (230) affixed to a take-up reel (430);

receiving (450) the sensed differential enviromental condition ($\Delta P$) through said pulled cable (230); and driving the take-up reel (430) in response to said received differential environmental condition (450) by means of a motor (440) at a rate sufficient to maintain the sensed differential condition ($\Delta P$) at substantially zero.

5. An improved system for measuring the velocity of fluids flowing in a well bore hole, wherein the improvement comprises:

means (310) selectively insertable into said well bore (10) for restricting the flow of said fluids (20), means (320) located above and below said restricting means (310) in said bore hole (10) for sensing a differential environmental condition ($\Delta P$) in said fluids (20), means (340, 430, 450, 440) responsive to said sensed differential environmental condition for pulling said restricting means (310) upwardly in said bore hole (10) through said fluids (20) at a velocity sufficient to reduce said sensed differential environmental condition ($\Delta P$) to substantially zero, and means (460, 470, 480) operatively connected to said restricting means (310) for measuring the velocity of said restricting means (310) as it moves upwardly through said fluids (20).

6. The improved system of claim 5, wherein said restricting means (310) comprises:

a central body (330), said central body (330) being operatively connected to said pulling means (340, 430, 450, 440) and carrying said sensing means (320), and a selectively expandable mechanism (335) around said central body (330) for impeding the flow of said fluids.

7. The improved system of claim 5 wherein said sensing means (320) comprises means for sensing the fluid pressure ($P_1$) above said restricting means (310) and the fluid pressure ($P_2$) below said restricting means (310).

8. The improved system of claim 5 wherein said pulling means comprises:

a cable (340) operatively connected to said restricting means (310), said cable (340) being capable of extending said sensed differential environmental condition ($\Delta P$) from said sensing means (320), a take-up reel (430) operative on said cable (340) for reeling up said cable (340), a motor (440) connected to said take-up reel (430) for driving said reel (430), and a feedback circuit (450) receptive of said extended sensed differential environmental condition ($\Delta P$)

from said cable (340) for controlling the rate at which said motor (440) drives said take-up reel (430).

9. The improved system of claim 5 wherein said measuring means comprises:

a cable tachometer (460) operatively engaging said cable (340) as said cable (340) is being pulled for measuring the velocity at which said restrictor (310) is being pulled upwardly, and means connected to said cable tachometer (460) for recording said velocity of said restrictor (310).

* * * * *

UNITED STATES PATENT AND TRADEMARK OFFICE

CERTIFICATE OF CORRECTION

PATENT NO. : 4,314,476

DATED : February 9, 1982

INVENTOR(S) : I. D. Johnson

It is certified that error appears in the above-identified patent and that said Letters Patent are hereby corrected as shown below:

Col. 2, line 20: Delete "of", second occurrence, and insert -- to --.

Col. 3, line 15: Following "upwardly" insert --,--.

Col. 3, line 33: Delete "occuring" and insert --occurring--.

Col. 4, line 21: Delete "acts" and insert --act--.

Col. 5, line 45: Following "7" insert --is--.

Col. 7, line 15: Delete "unexpected" and insert --unexpanded--.

Signed and Sealed this

*Twenty-second* Day of *June 1982*

[SEAL]

*Attest:*

*Attesting Officer*

GERALD J. MOSSINGHOFF

*Commissioner of Patents and Trademarks*